US011420253B2

(12) United States Patent
Schepak et al.

(10) Patent No.: US 11,420,253 B2
(45) Date of Patent: Aug. 23, 2022

(54) ALUMINUM CASTING DESIGN WITH ALLOY SET CORES FOR IMPROVED INTERMETALLIC BOND STRENGTH

(71) Applicant: Ford Global Technologies, LLC, Dearborn, MI (US)

(72) Inventors: Antony Schepak, Howell, MI (US); Clifford E. Maki, New Hudson, MI (US); James Boileau, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/004,391

(22) Filed: Aug. 27, 2020

(65) Prior Publication Data

US 2020/0391284 A1 Dec. 17, 2020

Related U.S. Application Data

(62) Division of application No. 15/869,012, filed on Jan. 11, 2018, now Pat. No. 10,780,491.

(51) Int. Cl.

| | |
|---|---|
| ***B22D 19/00*** | (2006.01) |
| ***C22F 1/04*** | (2006.01) |
| ***F02F 7/00*** | (2006.01) |

(52) U.S. Cl.

CPC ..... *B22D 19/0081* (2013.01); *B22D 19/0009* (2013.01); *C22F 1/04* (2013.01); *F02F 7/0021* (2013.01); *F02F 7/0053* (2013.01); *F02F 2200/06* (2013.01)

(58) Field of Classification Search

CPC ..... B22D 19/00; B22D 19/0009; B22D 19/0081; C22F 1/04; F02F 7/00; F02F 7/0021; F02F 7/0053; F02F 2200/06

USPC ..... 164/75, 91, 98, 100, 112; 148/523, 437

See application file for complete search history.

(56) References Cited

U.S. PATENT DOCUMENTS 4,746,582 A * 5/1988 Tsuno ..... B23K 35/002 428/627

10,780,491 B2 * 9/2020 Schepak et al. ..... C22F 1/04

* cited by examiner

*Primary Examiner* — Kevin P Kerns

(74) *Attorney, Agent, or Firm* — Burris Law, PLLC

(57) ABSTRACT

An engine block formed according to a method that includes forming an insert, coating the insert with a bond material, placing the insert within a casting mold or die, purging the casting mold or die with an inert gas, filling the casting mold or die with molten metal to encapsulate the insert, diffusion bonding the molten metal to the insert to form a diffusion bonded insert, placing the diffusion bonded insert within a cavity of a secondary casting mold or die, filling the secondary casting mold or die with molten metal to form an engine block composite casting assembly, and casting and heat treating the engine block composite casting assembly is provided. The insert can be free of serrations for mechanical coupling between the insert and the engine block.

18 Claims, 8 Drawing Sheets

ALUMINUM CASTING DESIGN WITH ALLOY SET CORES FOR IMPROVED INTERMETALLIC BOND STRENGTH

CROSS-REFERENCE TO RELATED APPLICATIONS

This application is a divisional of U.S. Pat. No. 10,780,491, filed on Jan. 11, 2018, titled ALUMINUM CASTING DESIGN WITH ALLOY SET CORES FOR IMPROVED INTERMETALLIC BOND STRENGTH. The disclosure of the above application is incorporated herein by reference.

FIELD

The present disclosure relates to cast parts, and more particularly to cast parts within an engine block.

BACKGROUND

The statements in this section merely provide background information related to the present disclosure and may not constitute prior art. Throughout the present disclosure, metallurgical bonds and molecular bonds are nearly synonymous.

Generally, the structure of an aluminum engine block is reinforced to achieve a high-power density, low-displacement engine. Often, pre-fabricated ferrous-based engine block inserts are used to transmit loads from an engine head deck to a crankshaft. The engine block inserts are usually cast into the engine block in a single operation, such as those disclosed in U.S. Pat. No. 9,719,461, which is commonly assigned with the present application and the contents of which are incorporated herein by reference in their entirety.

Unfortunately, dissimilar metals (e.g. aluminum and iron) rarely bond to one another during casting (e.g., High Pressure Die Casting (HPDC) or sand casting), and thus a bond is not created between the block insert and the parent assembly when casting an engine block. The lack of a bond between the engine block insert (iron) and the engine block alloy (aluminum) metal enables cracks to initiate at the aluminum-iron interfaces. Unfortunately, these cracks to grow during normal operating conditions, which could cause permanent damage and thus reduce the service life.

When loads are not transmitted efficiently, equally, or uniformly through engine components, including the insert and engine block, this may also lead to a reduced service life because the engine components undergo greater fatigue cycling. Therefore, reduced load-carrying capacity may result in reduced engine block fatigue life.

The present disclosure addresses issues related to dissimilar materials within engine blocks, their load-carrying and load-transferring capabilities, and other issues related to casting dissimilar metals.

SUMMARY

This section provides a general summary of the disclosure and is not a comprehensive disclosure of its full scope or all of its features.

In one form of the present disclosure, an engine block is formed according to a method that includes forming an insert, coating the insert with a bond material, placing the insert within a casting mold or die, purging the casting mold or die with an inert gas, filling the casting mold or die with molten metal to encapsulate the insert, diffusion bonding the molten metal to the insert to form a diffusion bonded insert, placing the diffusion bonded insert within a cavity of a secondary casting mold or die, filling the secondary casting mold or die with molten metal to form an engine block composite casting assembly, and casting and heat treating the engine block composite casting assembly. In some variations, the insert is free of serrations for mechanical coupling between the insert and the engine block.

In at least one variation, the insert is a material selected from the group consisting of a ferrous alloy, a nickel-based alloy, a super alloy, and a nonferrous alloy. In some variations, at least one external area of the insert is texturized and oxide-cleansed prior to coating with the bond material.

In at least one variation, the bond material is one of a copper material or a nickel material. Also, the bond material is applied by a process selected from the group consisting of electroforming, electroless coating, chemical vapor deposition (CVD), plasma vapor deposition (PVD), thermal spray, cold spray, and plasma spray. And in some variations, the bond material is applied in a thickness less than or equal to 1 mm, and the molten metal is aluminum and applied in a thickness up to 10 mm.

In at least one variation, the molten metal is aluminum. Also, in some variations the insert is completely encapsulated by the molten metal.

In at least one variation, the diffusion bonding step includes processing the inserts in a furnace.

In some variations, the step of heating the diffusion bonded insert and the cast part is carried out according to a heat treatment.

In at least one variation, a high pressure die casting (HPDC) method is used in the step of filling the casting mold or die with molten metal to encapsulate the insert. While in another variation a sand casting method is used in the step of filling the casting mold or die with molten metal to encapsulate the insert.

In another form of the present disclosure, an engine block with an insert is formed according to a method that includes forming an insert from an alloy, texturizing at least a portion of exterior surfaces of the insert, coating the insert with a bond material, placing the insert within a casting mold or die, purging the casting mold or die with an inert gas, filling the casting mold or die with molten aluminum metal to encapsulate the insert, diffusion bonding the molten aluminum metal to the insert to form a diffusion bonded insert, placing the diffusion bonded insert within a cavity of an aluminum cast engine block, and heating the diffusion bonded insert and the aluminum cast engine block together.

In some variations, the alloy is selected from the group consisting of a ferrous alloy, a nickel-based alloy, a super alloy, and a nonferrous alloy, and the bond material is one of a copper material or a nickel material.

In at least one variation, the bond material is applied by a process selected from the group consisting of electroforming, electroless coating, chemical vapor deposition (CVD), plasma vapor deposition (PVD), thermal spray, cold spray, and plasma spray. And in some variations the bond material is applied in a thickness less than or equal to 1 mm and the molten aluminum is applied in a thickness up to 10 mm.

In at least one variation, the insert is completely encapsulated by the molten metal.

In some variations, the diffusion bonding step includes processing the inserts in a furnace and/or the step of heating the diffusion bonded insert and the cast part is carried out according to a heat treatment.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
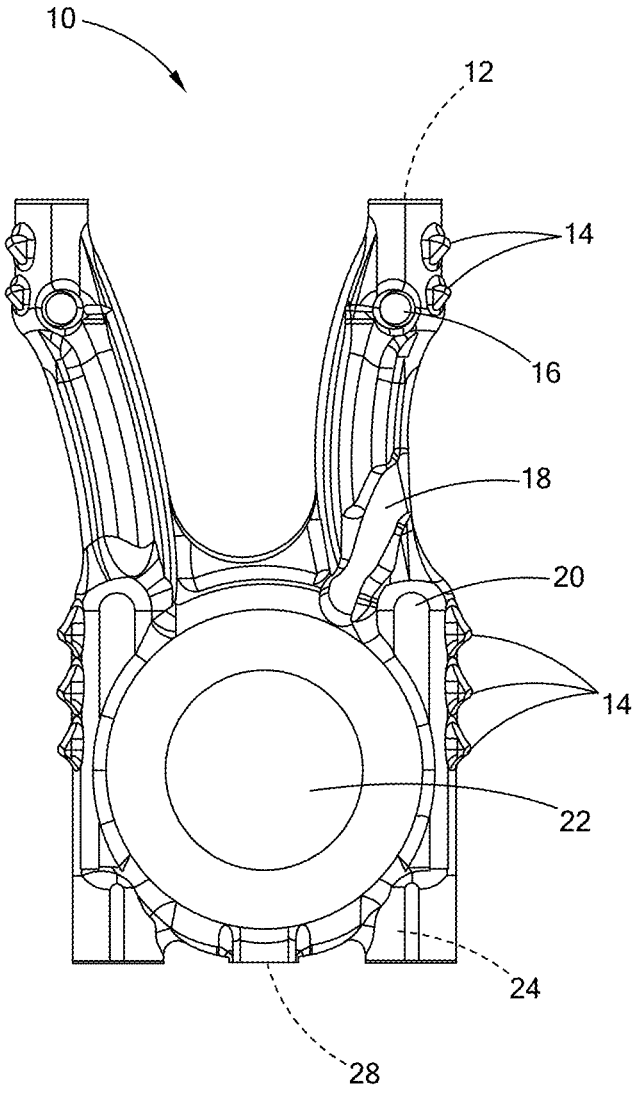
FIG. 1 PRIOR ART
FIG. 1 is a front view of an engine block insert according to the prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Generally, the present disclosure provides a method that creates a molecular bond between dissimilar metals that are cast, such as between an insert and a parent alloy housing material. The molecular bond improves load transmission and distribution between the dissimilar cast metals, which reduces overall mass and also eliminates certain features used in known inserts to improve bond strength. The improved load transmission and distribution enhances the application of multi-material products using aluminum and ferrous alloys. The present disclosure inhibits the formation of intermetallic phases that negatively impact the quality of the molecular bond.

The method that creates a molecular bond between the parent material (material a) and the insert (material 13), by diffusion bonding an intermediary layer (bond material) between the parent material and the insert. In general, the intermediary layer is a material that diffusion bonds well with both the parent material (material a) and the insert (material 13).

A form of the present disclosure provides a method for forming bulkhead inserts for castings, which in one form are engine blocks. The method creates molecular bonds that provide distributive load-bearing characteristics, thus providing a composite casting assembly that acts as a homogeneous material under loads. The method is applicable to both High Pressure Die Casting (HPDC) and sand casting processes, among others. Further, the method enables the use of multi-material products using mixed ferrous with aluminum alloys. The method does not require plasma temperatures to melt both interfacing contacting topologies or to merge (stir) the contacting topologies together at an atomic level when one component is a ferrous alloy and one component is an aluminum alloy The present disclosure provides a diffusion-based bonding process between dissimilar materials to create and stabilize a metallurgical bond between the dissimilar materials. Particularly, the metallurgical bond between an insert and an engine block. In general, any thin metallic material can be used that will bond readily with both the insert metal and the engine block metal. The method of the present disclosure has a reduced cost as compared to plasma processes. The method overcomes the bond strength issues experienced during solidification and reduces fatigue loading under cyclic engine loading events of an internal combustion engine.

Figure 2A:
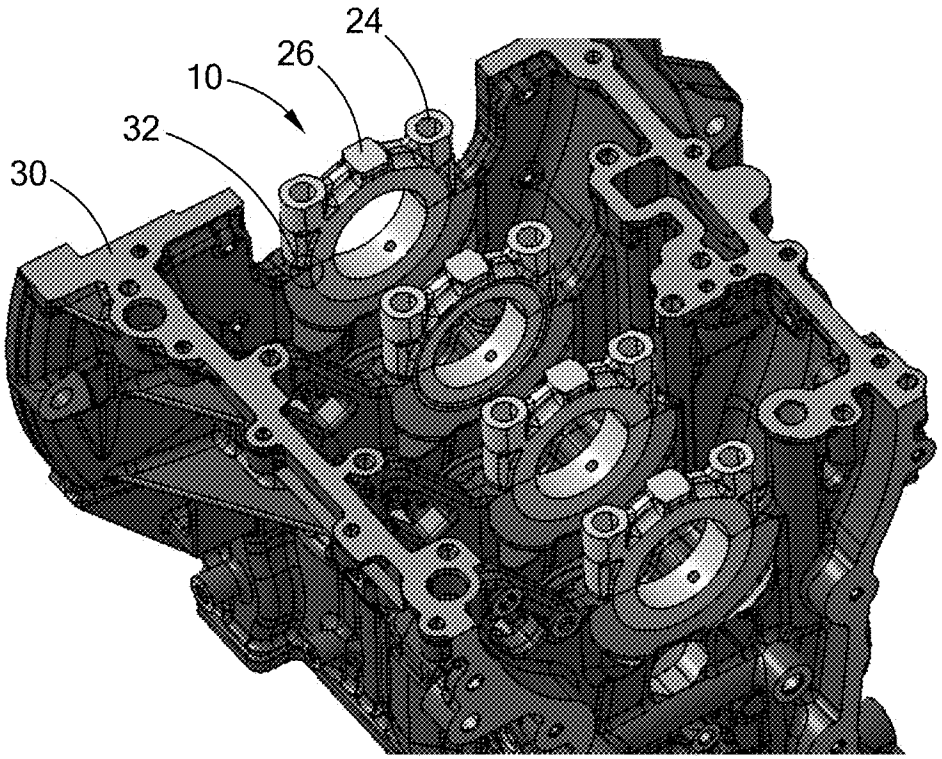
FIG. 2A PRIOR ART
FIG. 2A is a bottom partial perspective cutaway view of an engine block containing the inserts of FIG. 1.
Figure 2C:
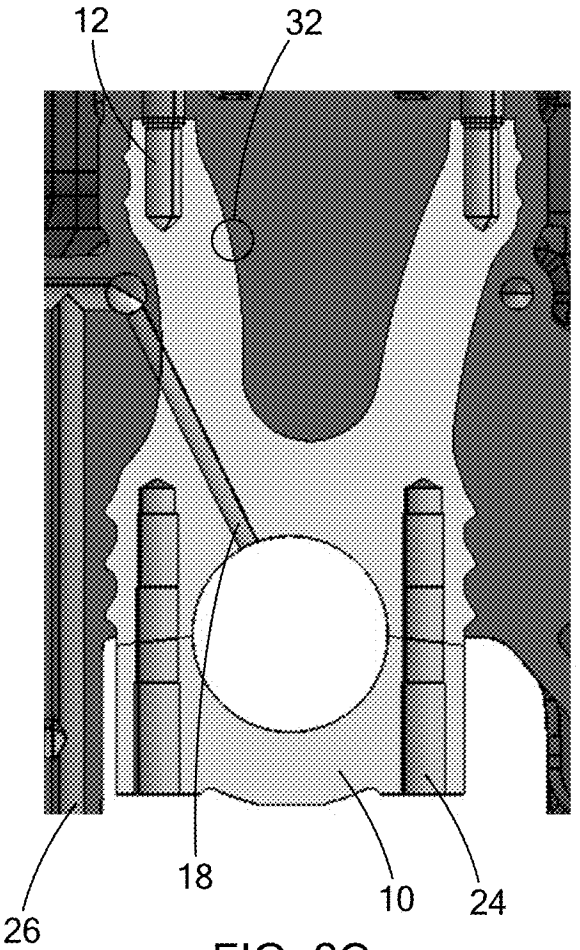
FIG. 2C PRIOR ART
FIG. 2C is an enlarged view of the insert of FIG. 2B.
Figure 2B:
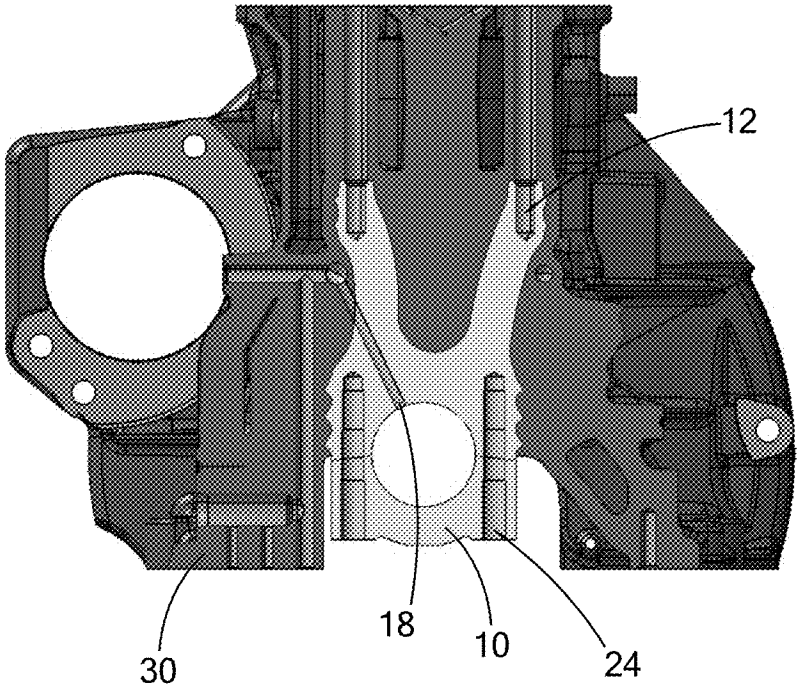
FIG. 2B PRIOR ART
FIG. 2B is a cross-sectional view of an upper portion of an insert and engine block constructed according to the teachings of the present disclosure.

Referring to FIG. 1, an exemplary prior art insert 10 is shown. The insert 10 includes a first mounting location 12, serrations 14, a first bearing surface 16, an internal fluid passageway 18, a second bearing surface 20, an insert cavity 22, a second mounting location 24, and a bearing location 28. The serrations 14, also referred to as "fingers," extend into the surrounding structure of an engine block 30 (shown in FIGS. 2A through 2C), which improve the mechanical coupling between the insert 10 and the engine block 30.

Figure 2D:
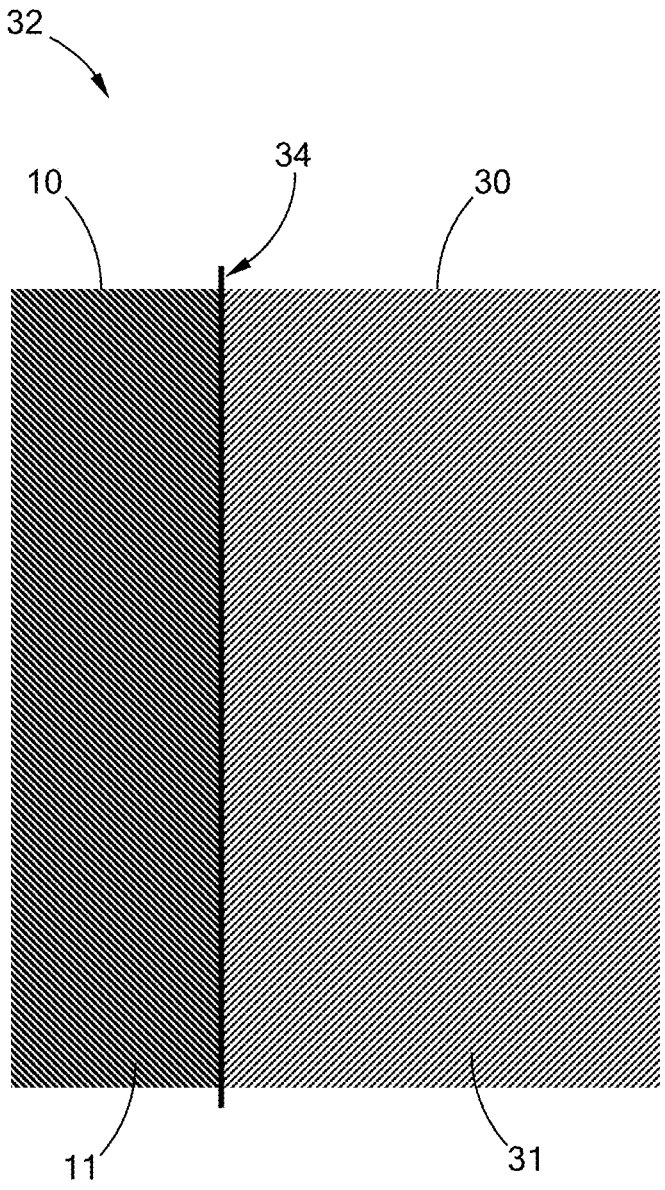
FIG. 2D PRIOR ART
FIG. 2D is an enlarged partial cross-sectional of a casting interface between the engine block and insert of FIG. 2A.

FIGS. 2A-2D depict an exemplary prior art engine block 30 cast with a plurality of inserts 10, and an exemplary interfacial casting area 32 between the engine block 30 and the insert 10. Either or both first mounting location 12 and the second mounting location 24 could be threaded, depending on the fastening or mounting configuration. FIG. 2D depicts the interfacial casting area 32 showing the insert 10 composed of an insert material 11, the engine block 30 composed of an engine block material 31, with a casting interface 34 between the insert 10 and the engine block 30.

The casting interface 34 is relatively thin and provides a mechanical connection between the insert 10 and the engine block 30. Due to the thin casting interface 34, the serrations 14 provide the requisite mechanical coupling between the insert 10 and the engine block 30.

Figure 3:
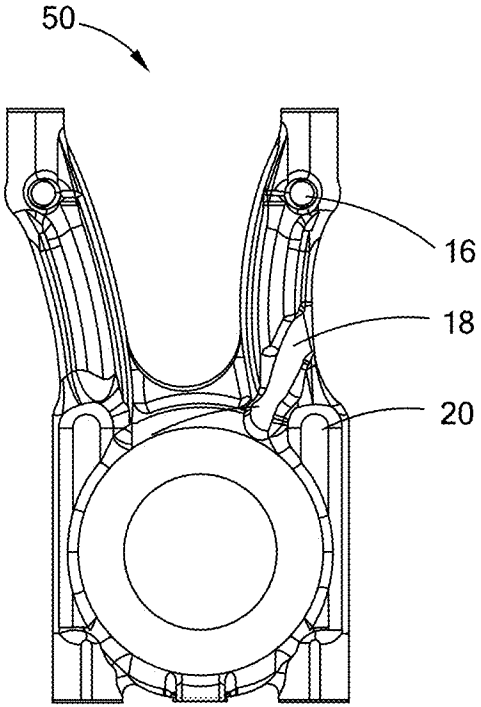
FIG. 3 is a front view of an insert according to the teachings of the present disclosure.

Referring now to FIG. 3, an insert according to the teachings of the present disclosure is illustrated and generally indicated by reference numeral 50. The insert 50 generally includes the geometric features of prior art insert 10, however, due to the inventive methods described herein, does not employ or require any serrations 14. However, it should be understood that the teachings of the present disclosure do not prohibit the use of serrations for a mechanical connection between insert 50 and the part to be cast around insert 50 to form a composite casting assembly.

Figure 4:
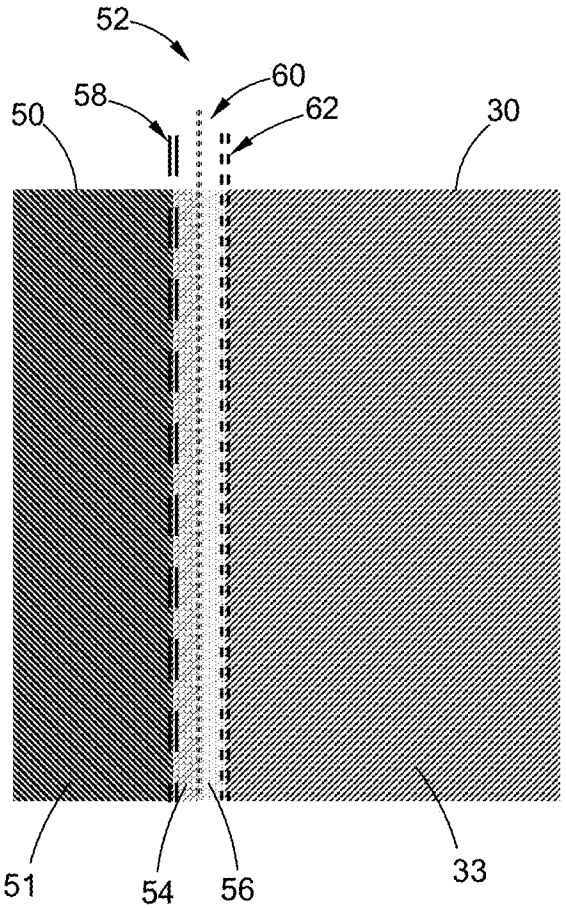
FIG. 4 is an enlarged partial cross-sectional view of a casting interface between an engine block and a block insert according to the teachings of the present disclosure.

FIG. 4 depicts an exemplary interfacial casting area 52 according to the teachings of the present disclosure. The insert 50 is composed of an insert material 51, and the engine block 30 is composed of first casting material 33, with interfacial casting area 52 between the insert 50 and the engine block 30. Interfacial casting area 52 also includes a coating material 54, a second casting material 56, a first coating interface 58, a second coating interface 60, and a second casting interface 62. The first coating interface 58 is between the insert material 51 of insert 50 and the coating material 54. The second coating interface 60 is between the coating material 54 and the second casting material 56. The second casting interface 62 is between the second casting material 56 and the first casting material 33 of the engine block 30. The first coating interface 58, the second coating interface 60, and the second casting interface 62 are all molecular bonds, according to the teachings of the present disclosure.

In an example of the present disclosure, insert 50 is ferrous (insert material 51), the engine block 30 is aluminum (first casting material 33), with the interfacial casting area 52 between the ferrous insert 50 and the aluminum engine block 30. In one form, the coating material 54 is copper, the second casting material 56 is aluminum, the first coating interface 58 is electroformed, second coating interface 60 is diffusion bonded, wherein the second casting interface 62 bonds well with the aluminum engine block 30 as both materials are aluminum.

As described in greater detail below, the insert 50 is coated with the coating material 54 and placed within a mold or die. The mold or die is then purged with an inert gas and filled with a molten metal. Heat is then applied to diffusion bond the molten metal to the coated insert to form a diffusion bonded insert. The heating and filling with molten metal may be concurrent processes, or they may be separate sequential steps. The diffusion bonded insert is then placed into a secondary casting mold or die (a different casting mold or die), which contains a parent component such as the engine block 30, and the secondary casting mold or die is filled with molten metal, encapsulating the diffusion bonded insert and forming a composite casting assembly. The composite casting assembly is also heated to stabilize its structure and properties.

As used herein, the term "encapsulate," "encapsulated," and "encapsulating" should be construed to mean covering at least a portion of the insert 50 with the coating material 54 and not necessarily covering all exterior surfaces of the insert 50. Although one form of the present disclosure involves complete encapsulation of all exterior surfaces of the insert 50 ("completely encapsulated"), it should be understood that only select exterior surfaces may be coated with the coating material 54 and still be "encapsulated" according to the teachings of the present disclosure.

The methods of the present disclosure are at least applicable to engine blocks, cylinder heads, or any part that employs a load-bearing cast-in insert. Example applications include, but are not limited to: (1) bulkhead reinforcement inserts of ferrous metal cast into an aluminum engine block main bearing web region; (2) cylinder liners; (3) cylinder blocks using a bedplate with ferrous metal insert to improve structural stiffness; (4) head bolt inserts in cylinder blocks; and (5) valve seat inserts in cylinder heads.

Figure 5:
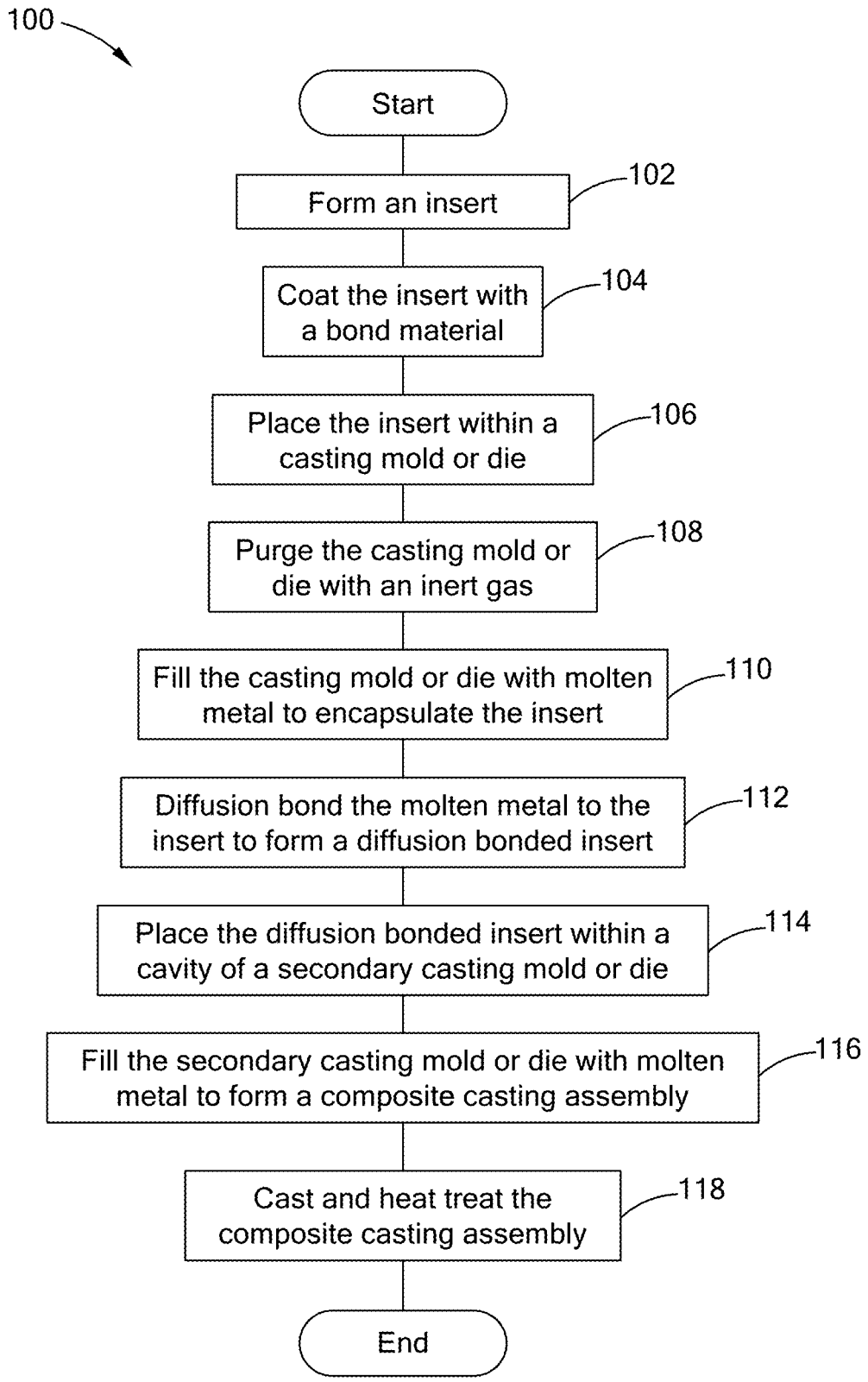
FIG. 5 is a flow chart of an exemplary method for forming an assembly according to the teachings of the present disclosure.

Referring to FIG. 5, one form of the present disclosure, a method 100 of forming an assembly is provided. The method 100 comprises forming an insert 102, coating the insert with a bond material 104 and placing the insert within a casting mold or die 106. The casting mold or die is purged with an inert gas 108 and the casting mold or die is filled with molten metal to encapsulate the insert 110. The encapsulated insert is diffusion bonded to the molten metal to form a diffusion bonded insert 112, which is placed within a cavity of a secondary casting mold or die 114. The secondary casting mold or die is filled with molten metal to form a composite casting assembly 116. After or during the casting, the composite casting assembly is heat treated 118.

In a variation of this method, the insert includes ferrous alloys, nickel-based alloys, super alloys, and nonferrous alloys. In additional variations, at least one external area of the insert is texturized and oxide-cleansed prior to coating with the bond material, the bond material is one of a copper material or a nickel material, the bond material is applied by a process that includes electroforming, electroless coating, chemical vapor deposition (CVD), plasma vapor deposition (PVD), thermal spray, cold spray, and plasma spray, the cast part is an engine block, the bond material is applied in a thickness less than or equal to 1 mm, and the molten metal is aluminum and applied in a thickness up to 10 mm, the molten metal is aluminum, the insert is completely encapsulated by the molten metal, the diffusion bonding step includes processing the inserts in a furnace, the step of heating the diffusion bonded insert and the cast part is carried out according to a heat treatment, a high pressure die casting (HPDC) method is used in the step of filling the casting mold or die with molten metal to encapsulate the insert, and a sand casting method is used in the step of filling the casting mold or die with molten metal to encapsulate the insert. The present disclosure also provides an engine block manufactured according to the teachings of the present disclosure.

Figure 6:
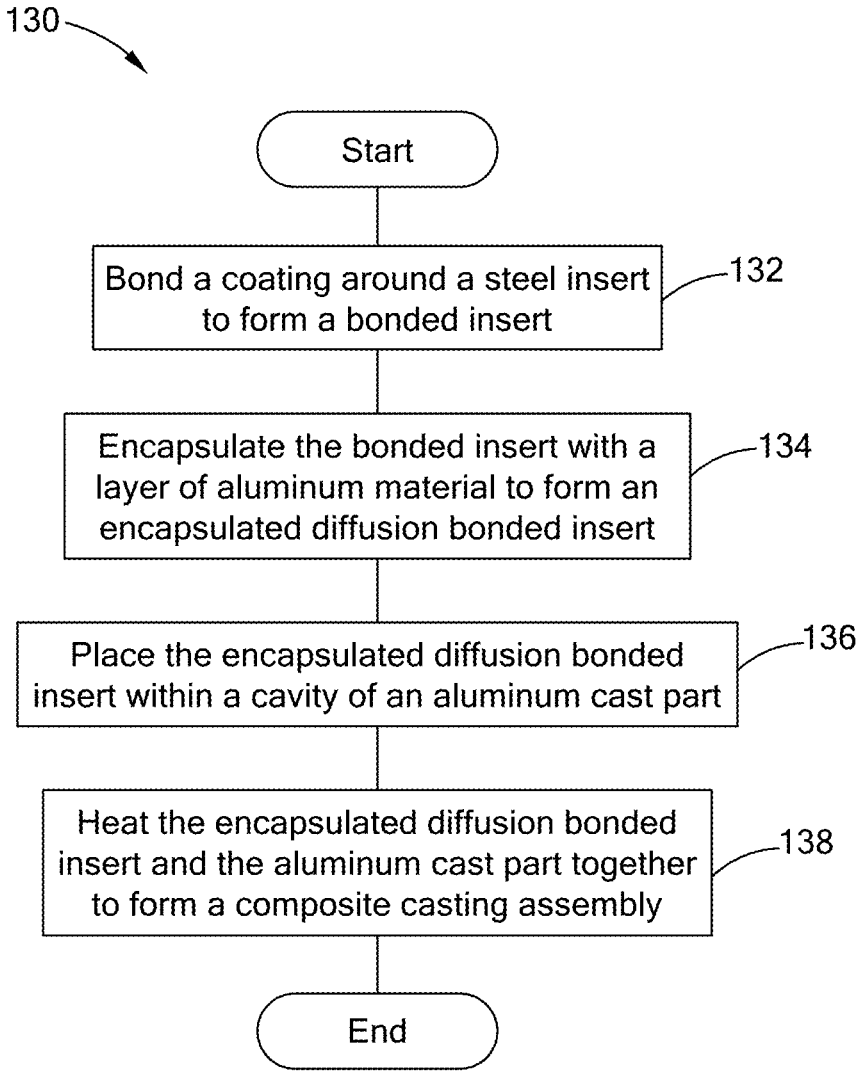
FIG. 6 is a flow chart of another exemplary method for forming an assembly according to the teachings of the present disclosure.

Referring to FIG. 6, another form of the present disclosure includes a method 130 of forming an assembly. The method 130 comprises bonding a coating around a steel insert to form a bonded insert 132, encapsulating the bonded insert with a layer of aluminum material to form an encapsulated diffusion bonded insert 134, and placing the encapsulated diffusion bonded insert within a cavity of an aluminum cast part 136. Then the encapsulated diffusion bonded insert and the aluminum cast part are heated together to form a composite casting assembly 138.

In a variation of this method, the coating is one of a copper material or a nickel material. In another method of the present disclosure, the coating defines a thickness less than or equal to 1 mm. In further variations of this method, the aluminum material defines a thickness up to 10 mm, and at least a portion of exterior surfaces of the insert are texturized prior to bonding the coating.

Figure 7:
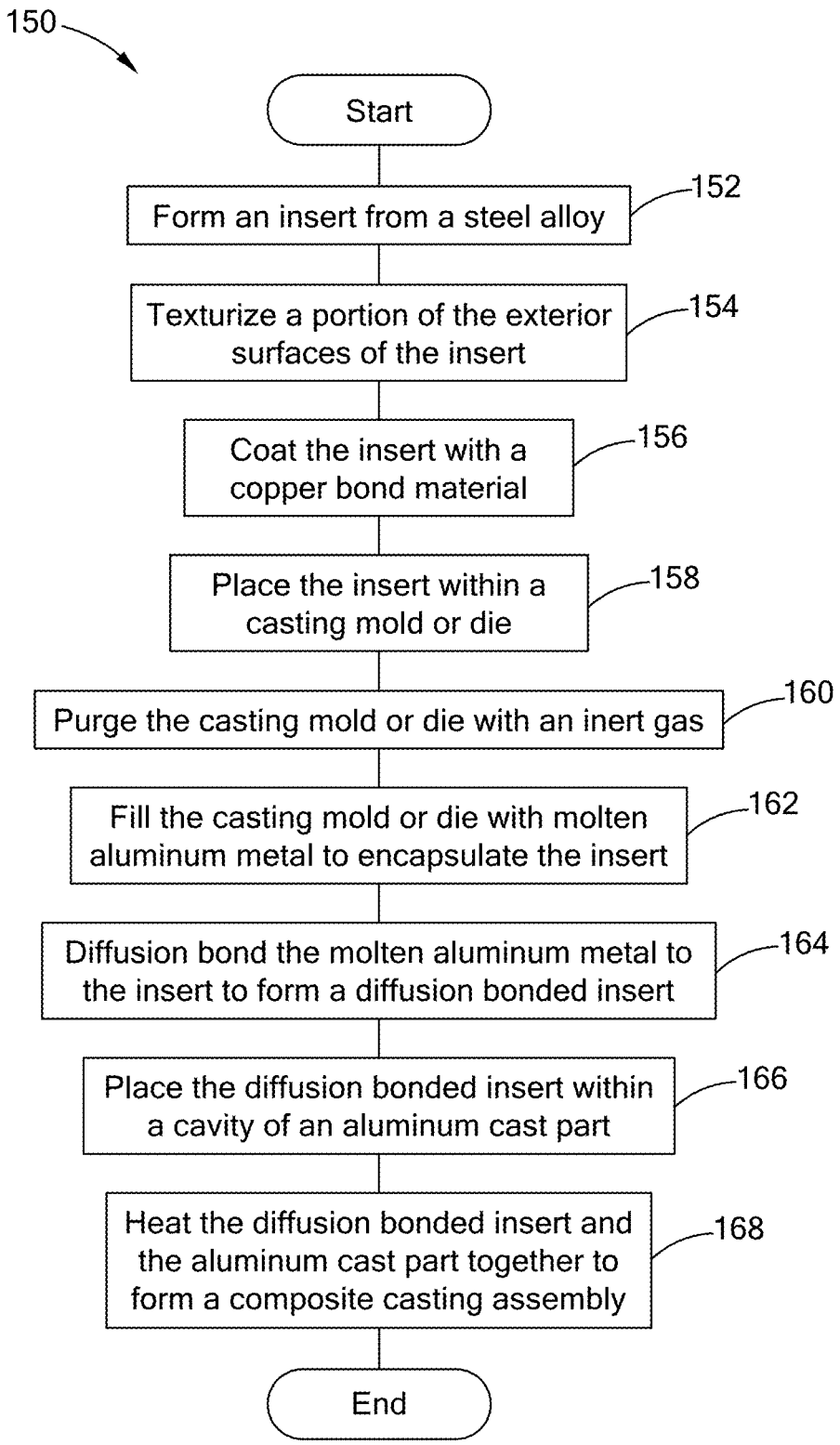
FIG. 7 is a flow chart of yet another method for forming an insert for use in an assembly according to the teachings of the present disclosure.

Referring to FIG. 7, in yet another form of the present disclosure, a method 150 of forming an insert for use in an assembly is provided. The method 150 comprises forming an insert from a steel alloy 152, texturizing at least a portion of the exterior surfaces of the insert 154, and coating the insert with a copper bond material 156. The coated insert is placed within a casting mold or die 158 and the casting mold or die is purged with an inert gas 160. The casting mold or die is filled with molten aluminum metal to encapsulate the insert 162, which is heated to diffusion bond the molten aluminum metal to the insert to form a diffusion bonded insert 164. The diffusion bonded insert is placed within a cavity of an aluminum cast part 166 and both are heated together to form a composite casting assembly 168.

In an exemplary method of forming a part by diffusion bonding the insert 50 to the engine block 30, where compacted graphite iron (CGI) is the insert material and a nickel-based alloy is the diffusion-bonding material, the following steps are employed:

1. Creating a steel alloy block insert using one or more standard manufacturing techniques such as casting, powder metallurgy, forging, and/or machining.

2. Performing an optional grit blasting operation on insert to texturize external surfaces and performing an optional oxide-cleaning which promotes adhesion during the electroforming process.

3. Coating the insert with a thin (0.5-1.5 nm or 5-15 angstroms (Å)) copper layer using an electroforming process. Copper is chosen in one form of the present disclosure as copper will diffusion bond well with both iron and aluminum.

4. Placing the coated block insert into a HPDC casting die. The casting die is closed and an inert gas (e.g. Argon or Nitrogen gas) is used to flood the casting die and displace the oxygen-containing atmosphere. The inert gas reduces or negates oxidation of the coated block insert during the HPDC casting.

5. Injecting molten aluminum into the casting die using a standard HPDC process. In one form, the inserts are completely encapsulated by an aluminum layer up to 10 mm in thickness. The high pressures associated with HPDC promotes solidification of the aluminum alloy in direct contact with the CGI insert.

6. Removing the encapsulated insert from the HPDC casting die.

7. Placing the encapsulated insert into a furnace to diffusion bond the aluminum to the encapsulated insert, thus creating a diffusion bonded insert.

8. Placing the diffusion bonded insert into an engine block casting die and using conventional HPDC processes to cast aluminum around the diffusion bonded insert, creating a composite casting assembly.

9. Transferring the composite casting assembly to a furnace and heat treating the composite casting assembly to achieve a T5 heat treatment. This heat treatment also operates as an artificial aging process improves the strength of the composite casting assembly.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An assembly formed according to a method comprising:

forming an insert;

coating the insert with a bond material;

placing the insert within a casting mold or die;

purging the casting mold or die with an inert gas;

filling the casting mold or die with molten metal such that the insert is encapsulated within the molten metal in the casting mold or die to form an encapsulated insert;

diffusion bonding the molten metal to the encapsulated insert to form a diffusion bonded insert;

placing the diffusion bonded insert within a cavity of a secondary casting mold or die; and casting a composite casting assembly, wherein the casting includes filling the secondary casting mold or die with another molten metal to form the composite casting assembly, the composite casting assembly comprising the diffusion bonded insert with the encapsulated insert and the metal from the secondary casting mold or die, wherein the diffusion bonded insert is completely encapsulated within a solidified metal.

2. The assembly according to claim 1, wherein the insert is free of serrations providing mechanical locking between the insert and the composite casting assembly.

3. The assembly according to claim 1, wherein the insert is a material selected from the group consisting of a ferrous alloy, a nickel-based alloy, a super alloy, and a nonferrous alloy and the composite casting assembly is an engine block composite casting assembly.

4. The assembly according to claim 1, wherein at least one external area of the insert is texturized and oxide-cleansed prior to coating with the bond material.

5. The assembly according to claim 1, wherein the bond material is one of a copper material or a nickel material.

6. The assembly according to claim 5, wherein the bond material is applied by a process selected from the group consisting of electroforming, electroless coating, chemical vapor deposition (CVD), plasma vapor deposition (PVD), thermal spray, cold spray, and plasma spray.

7. The assembly according to claim 6, wherein the bond material is applied in a thickness less than or equal to 1 mm, and the molten metal is aluminum and applied in a thickness up to 10 mm.

8. The assembly according to claim 1, wherein the molten metal is aluminum.

9. The assembly according to claim 1, wherein the diffusion bonding step includes processing the encapsulated insert in a furnace.

10. The assembly according to claim 1, further comprising a step of heat treating the composite casting assembly.

11. The assembly according to claim 1, wherein a high pressure die casting (HPDC) method is used in the step of filling the casting mold or die with molten metal to encapsulate the insert.

12. The assembly according to claim 1, wherein a sand casting method is used in the step of filling the casting mold or die with molten metal to encapsulate the insert.

13. A composite casting assembly formed according to a method comprising:

forming an insert from an alloy;

texturizing at least a portion of exterior surfaces of the insert;

coating the insert with a bond material;

placing the insert within a casting mold or die;

purging the casting mold or die with an inert gas;

filling the casting mold or die with molten aluminum metal such that the insert is encapsulated within the molten aluminum metal in the casting mold or die to form an encapsulated insert;

diffusion bonding the molten aluminum metal to the encapsulated insert to form a diffusion bonded insert;

placing the diffusion bonded insert within a cavity of an aluminum cast part; and casting the diffusion bonded insert with the encapsulated insert and the aluminum cast part together by heating the diffusion bonded insert with the encapsulated insert and the aluminum cast part together to form a composite casting assembly, the composite casting assembly comprising the diffusion bonded insert with the encapsulated insert and the aluminum cast part, wherein the diffusion bonded insert is completely encapsulated within a solidified aluminum metal.

14. The part with the insert according to claim 13, wherein the aluminum casting is an aluminum cast engine block and the alloy is selected from the group consisting of a ferrous alloy, a nickel-based alloy, a super alloy, and a nonferrous alloy.

15. The part with the insert according to claim 14, wherein the bond material is one of a copper material or a nickel material.

16. The part with the insert according to claim 15, wherein the bond material is applied by a process selected from the group consisting of electroforming, electroless coating, chemical vapor deposition (CVD), plasma vapor deposition (PVD), thermal spray, cold spray, and plasma spray.

17. The part with the insert according to claim 15, wherein the bond material is applied in a thickness less than or equal to 1 mm and the molten aluminum is applied in a thickness up to 10 mm.

18. The part with the insert according to claim 13, further comprising a step of heat treating the composite casting assembly.

* * * * *